US006948950B2

(12) United States Patent
Yamaguchi

(10) Patent No.: US 6,948,950 B2
(45) Date of Patent: Sep. 27, 2005

(54) ELECTRICAL CONNECTOR BOX

(75) Inventor: Jun Yamaguchi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/632,964

(22) Filed: Aug. 4, 2003

(65) Prior Publication Data

US 2004/0029420 A1 Feb. 12, 2004

(30) Foreign Application Priority Data

Aug. 6, 2002 (JP) ..... 2002-229181

(51) Int. Cl.[7] ..... H01R 9/09
(52) U.S. Cl. ..... 439/76.2; 361/704
(58) Field of Search ..... 439/76.1, 76.2, 439/34, 629; 361/704, 710, 601; 257/706, 707, 712, 713; 165/80.2, 3, 184; 174/16.3, 50, 52.1

(56) References Cited

U.S. PATENT DOCUMENTS 5,882,213 A * 3/1999 Witek et al. ..... 439/76.2
5,946,192 A * 8/1999 Ishigami et al. ..... 361/704
6,583,353 B2 * 6/2003 Murakoshi et al. ..... 174/50
6,785,139 B2 * 8/2004 Onizuka et al. ..... 361/704

* cited by examiner

*Primary Examiner*—Alexander Gilman
(74) *Attorney, Agent, or Firm*—Greenblum & Bernstein, P.L.C.

(57) ABSTRACT

An electrical connector box is provided which includes a case containing inner compartments. A side opening communicating with the inner compartments is provided on a side of the case. A power distribution unit is inserted into and covers the side opening of the case in a vertical orientation. A side frame is connected to a perimeter of the power distribution unit and to the case for mounting the power distribution unit onto the case. The vertical orientation of the power distribution unit requires less horizontal space for the electrical connector box in a vehicle.

21 Claims, 6 Drawing Sheets

ELECTRICAL CONNECTOR BOX

BACKGROUND OF THE INVENTION

1. Field of the Invention

The invention relates to a compact electrical connector box, such as a connector box for use in a vehicle, into which a large number electronic devices, fuses, and other related components can be installed.

2. Description of the Related Art

Automotive electrical connector boxes, such as junction boxes and the like, are used to house multiple relays, fuses, bus bars, and terminal connectors that join the components in the connector box to the vehicle's wiring harness. The recent increase in the number of electrical circuits and components installed in vehicles has made it necessary to increase the size of the electrical connector box in order to house more electrical components.

For example, FIG. 6 illustrates a conventional electrical connector box 1 that provides upper spaces 1*a* and 1*b* for the respective installation of multiple relays and fuses. As a result, this structure has a relatively large horizontal surface area that requires a large mounting space on the vehicle. There are also situations in which a separate relay block RB must be installed in the vehicle for holding additional components.

SUMMARY OF THE INVENTION

The present invention has been made in view of the above-described problems. Accordingly, it is an object of the present invention to provide a structure for an electrical connector box in which the horizontal surface area of the connector box, in which the electrical circuits and electrical component assemblies are installed, is reduced. This provides a more compact connector box that requires less installation space.

According to one aspect of the present invention, there is provided an electrical connector box including a case having open top and bottom portions, and a side opening provided on a side of the case, a top cover for covering the open top portion, and a bottom cover for covering the open bottom portion. The electrical connector box also includes a power distribution unit having a printed circuit board that includes a first surface with bus bars thereon and a second surface with electronic components thereon, with the bus bars and electronic components being electrically connected through openings provided in the printed circuit board. The power distribution unit further includes a circuit board frame surrounding a perimeter portion of the printed circuit board, and having a central opening through which a central portion of the printed circuit board is exposed. The power distribution unit further includes a metal plate having a first surface positioned against the circuit board frame to cover the first surface of the printed circuit board, with the metal plate including cooling fins on a second surface thereof. Additionally, the case may contain plural inner compartments having open top and bottom portions, plural top covers for covering the open top portions of the inner compartments, and a bottom cover for covering the open bottom portions of the inner compartments. The first surface of the metal plate may cover the central opening of the circuit board frame.

The electrical connector box also includes a side frame that connects to a perimeter of the power distribution unit and to the case for mounting the power distribution unit onto the case with the cooling fins exposed. The power distribution unit is inserted into and covers the side opening of the case in a vertical orientation, so that the electronic components on the second surface of the printed circuit board are oriented toward an interior of the case, and the cooling fins are oriented toward an exterior of the case. Additionally, the electronic components on the second surface of the printed circuit board may be oriented toward the inner compartments of the case.

According to a further aspect of the present invention, the circuit board frame includes plural terminal connector receptacles which extend toward the interior of the case, and the bus bars include end tab portions bent around edges of the printed circuit board and extending beyond the second surface of the printed circuit board into the terminal connector receptacles of the circuit board frame. In this manner, terminal connectors on the ends of electrical wires are horizontally inserted into the terminal connector receptacles with the electric wires extending through cutout portions provided in the bottom cover. The plural terminal connector receptacles may extend toward the inner compartments of the case.

According to a further aspect of the present invention, the circuit board frame includes plural parallel fins which extend toward the exterior of the case. The fins of the circuit board frame are aligned with and adjacent to end portions of the cooling fins of the metal plate.

According to a further aspect of the present invention, the power distribution unit includes an upper latch tab configured to engage a latch opening provided in the case above the side opening. The power distribution unit is fastened to the case with at least one bolt and at least one nut.

According to a further aspect of the present invention, the case includes opposed wall portions adjacent to the side opening, the opposed wall portions including plural lock tabs configured to engage with plural lock clips provided on the side frame for connecting the side frame to the case.

According to a further aspect of the present invention, the side frame includes an upper stopper lip configured to be inserted into a latch bracket provided on the case above the side opening. The power distribution unit includes an upper latch tab configured to engage a latch opening provided in the case above the side opening. Further, the latch bracket extends upwardly from the perimeter of the latch opening, whereby insertion of the stopper lip into the latch bracket covers the latch opening.

According to a further aspect of the present invention, the case includes an inner partition wall separating a large inner compartment configured to contain a fusible link block from a small inner compartment configured to contain a relay block. The side opening is provided in an outer wall of the large inner compartment. Further, the bottom cover covers the open bottom portions of the large inner compartment and the small inner compartment, and the bottom cover includes cutout portions through which electric wires connected to the fusible link block and the relay block extend.

According to another aspect of the present invention, there is provided an electrical connector box including a case containing at least one inner compartment and a side opening provided on a side of the case and communicating with the at least one inner compartment. The electrical connector box further includes a power distribution unit inserted into and covering the side opening of the case in a vertical orientation, and a side frame connected to a perimeter of the power distribution unit and to the case for mounting the power distribution unit onto the case.

According to a further aspect of the present invention, the at least one inner compartment includes a large inner compartment configured to contain a fusible link block and a small inner compartment configured to contain a relay block. The side opening is provided in an outer wall of the large inner compartment, and the case further includes a bottom cover having cutout portions through which electric wires connected to the fusible link block and the relay block extend.

According to a further aspect of the present invention, the power distribution unit includes a printed circuit board having a first surface with bus bars thereon and a second surface with electronic components thereon. The power distribution unit further includes a circuit board frame surrounding a perimeter portion of the printed circuit board, with the circuit board frame having a central opening through which a central portion of the printed circuit board is exposed. The power distribution unit also includes a metal plate having a first surface positioned against the circuit board frame to cover the first surface of the printed circuit board. The metal plate also has cooling fins on a second surface thereof. Additionally, the first surface of the metal plate may cover the central opening of the circuit board frame.

According to a further aspect of the present invention, the power distribution unit is inserted into and covers the side opening of the case in a vertical orientation, so that the electronic components on the second surface of the printed circuit board are oriented toward the at least one inner compartment of the case, and the cooling fins are oriented toward the exterior of the case.

According to a further aspect of the present invention, the circuit board frame includes plural terminal connector receptacles which extend toward the at least one inner compartment of the case. The bus bars include end tab portions bent around edges of the printed circuit board and extending beyond the second surface of the printed circuit board into the terminal connector receptacles of the circuit board frame.

According to a further aspect of the present invention, terminal connectors on the ends of electrical wires are horizontally inserted into the terminal connector receptacles of the circuit board frame, and the electric wires extend through cutout portions provided in a bottom cover of the case.

According to a further aspect of the present invention, the circuit board frame includes plural parallel fins which extend toward the exterior of the case. The fins of the circuit board frame are aligned with and adjacent to end portions of the cooling fins of the metal plate.

The circuit board of the power distribution unit may include electronic switching elements instead of relays. These electronic switching elements and other electronic components are mounted on one side of the circuit board, and bus bars are soldered to the other side of the circuit board, allowing the circuit board to contain a large number of branch circuits in a highly dense configuration. The circuit board is prevented from overheating by locating the cooling fins adjacent to the side of the circuit board to which the bus bars are attached.

Further, by mounting the power distribution unit onto the case in a vertical orientation, the horizontal surface area (footprint) of the connector box can be reduced by approximately 30 percent as compared to conventional units. By replacing relays with electronic switching elements (FETs), the weight of the connector box can be reduced by approximately 15 percent as compared to conventional units. Accordingly, the connector box of the present invention significantly reduces both the size and weight of the electrical connector box as compared to conventional units.

The structure of the present invention also allows for all of the semiconductor switching elements and electrical components to be easily and quickly connected to their appropriate circuits by the insertion of wire terminal connectors into the connector receptacles provided on the power distribution unit. Also, since the power distribution unit is mounted onto the case in a vertical orientation, the wire terminal connectors can be inserted horizontally into the connector receptacles which extend from the power distribution unit in a horizontal direction.

Many conventional power distribution units place the connector receptacles on a horizontal surface with the receptacle openings facing upward or downward. This type of structure requires relatively long lengths of wire to be routed to positions above or below the connector box. Even in situations in which the power distribution unit can be inserted into the connector box from above, long lengths of wire must be connected to the connector receptacles before the power distribution unit is mounted onto the connector box. However, the present invention provides a structure that mounts the power distribution unit to a vertical side of the case in a vertical orientation, thus allowing for the wires connected to the connector receptacles to be of significantly shorter length.

Plural fins may extend in parallel alignment from the external surfaces of the upper and lower members of the circuit board frame. When the circuit board frame is assembled with the metal plate, the metal plate cooling fins cover the side of the circuit board to which the bus bars are attached, and the cooling fins align between the fins on the circuit board frame. This structure allows the cooling fins on the metal plate to effectively direct heat from the bus bars to the external environment, thus improving the dependability of the circuit, and providing a structure in which the ends of the metal plate cooling fins are covered by the fins on the circuit board frame. An electrically insulating plastic resin may be applied in the region between the bus bars and metal plate to provide insulation.

The power distribution unit is inserted between right and left receiver members that extend from the left and right sides of the case at the side opening. Lock tabs are formed on the receiver members, and lock clips, formed on the left and right members of the side frame, engage the lock tabs to establish a preliminary connection between the side frame and the case. This structure allows the power distribution unit to be securely mounted to the case while simultaneously providing an easily formed water-tight seal between the two components.

A latch tab is formed on the upper edge of the power distribution unit, and a latch opening is provided on the frame member defining the top of the side opening of the case. Installing the power distribution unit into the case engages the latch tab into the latch opening to form a preliminary connection between the two components, after which bolts and nuts are used to further secure the power distribution unit to the case. This structure provides an indexing function that locates the power distribution unit relative to the case, thus providing a convenient attachment method in which the bolts can be inserted without the need to manually align the power distribution unit relative to the case.

A stopper lip, provided on the upper member of the side frame, extends inward toward the case, and a latch bracket is provided on the upper frame member defining the side opening, thus forming a structure in which the stopper lip may be inserted into the latch bracket. The stopper lip provides an indexing function that accurately aligns the side frame around the edges of the power distribution unit, thus simplifying attachment of the side frame to the case. Furthermore, the insertion of the stopper lip into the latch bracket provides a locking function that improves the security with which the side frame is attached to the case. The insertion of the stopper lip into the latch bracket, which extends from the perimeter of the latch opening, forms a structure that prevents the entry of water into the latch opening.

The relay block allows for the installation of additional switching devices in situations in which the semiconductor switching elements in the power distribution unit cannot perform all of the required switching functions. Further, by allowing for wires originating at the relay block, fusible link block, and/or terminal connectors to exit through the cutout sections in the lower cover, the wires can be routed more directly to their destinations through the appropriate positioning of such cutout sections.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE PREFERRED EMBODIMENTS

Figure 1:
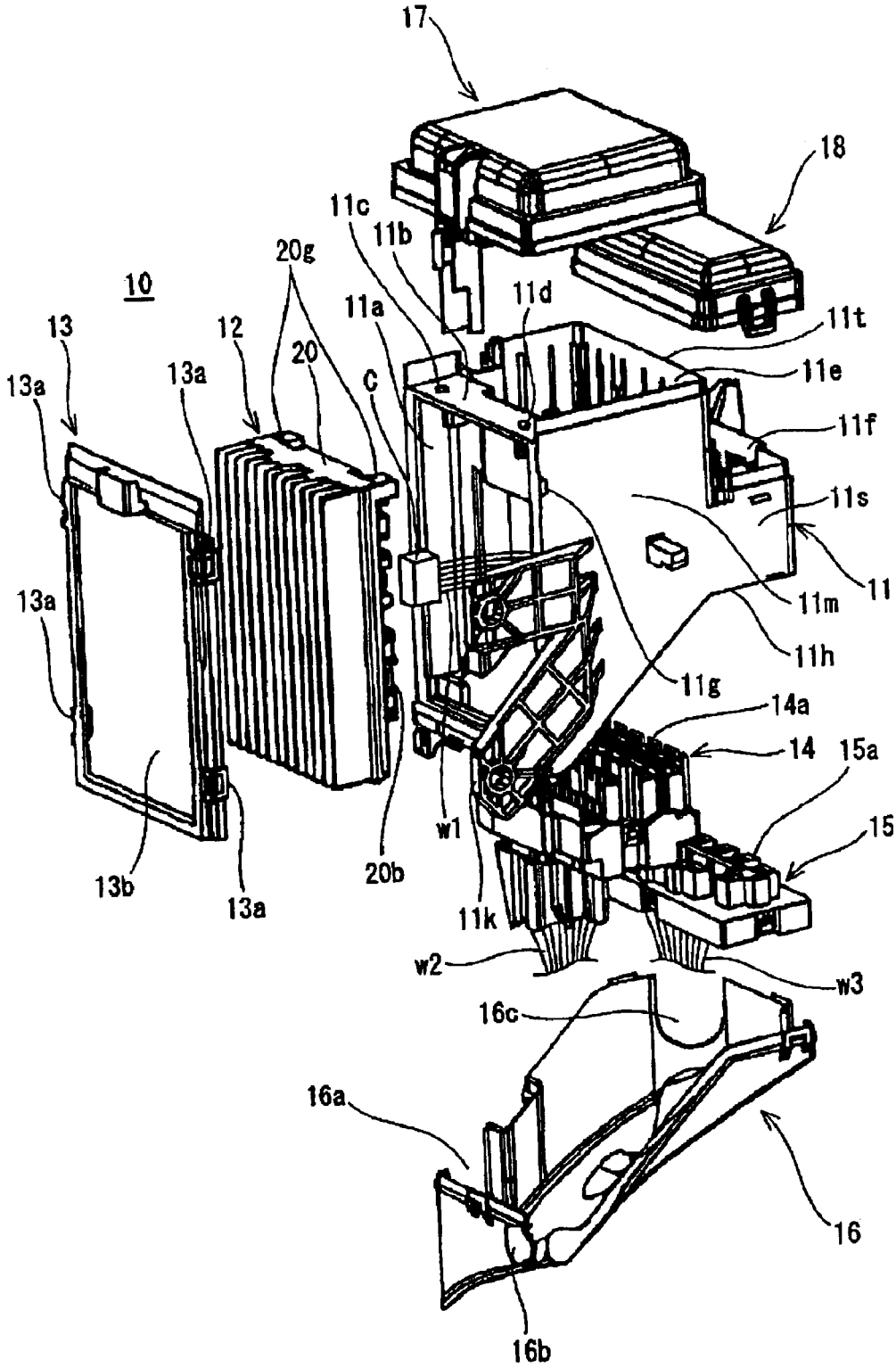
FIG. 1 is an exploded perspective view of the connection box of a first embodiment of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe various embodiments of the invention with reference to the drawings.

FIGS. 1 through 4 illustrate a first embodiment of the invention in the form of an electrical connector box 10. A power distribution unit 12 (hereafter PDU 12) is installed in a side opening 11*a* of a case 11 in a vertical orientation, and fixed thereto by the attachment of a side frame 13. A partition wall 11*t* of case 11 separates a large compartment 11*m*, into which a fusible link block 14 is installed, and a small compartment 11*s*, into which a relay block 15 is installed. A first lid 17 and a second lid 18 respectively attach to and seal an upper opening 11*e* of large compartment 11*m* and an upper opening 11*f* of small compartment 11*s*. A lower case part 16 attaches to and seals a bottom opening 11*h* of both large compartment 11*m* and small compartment 11*s*.

Figure 3:
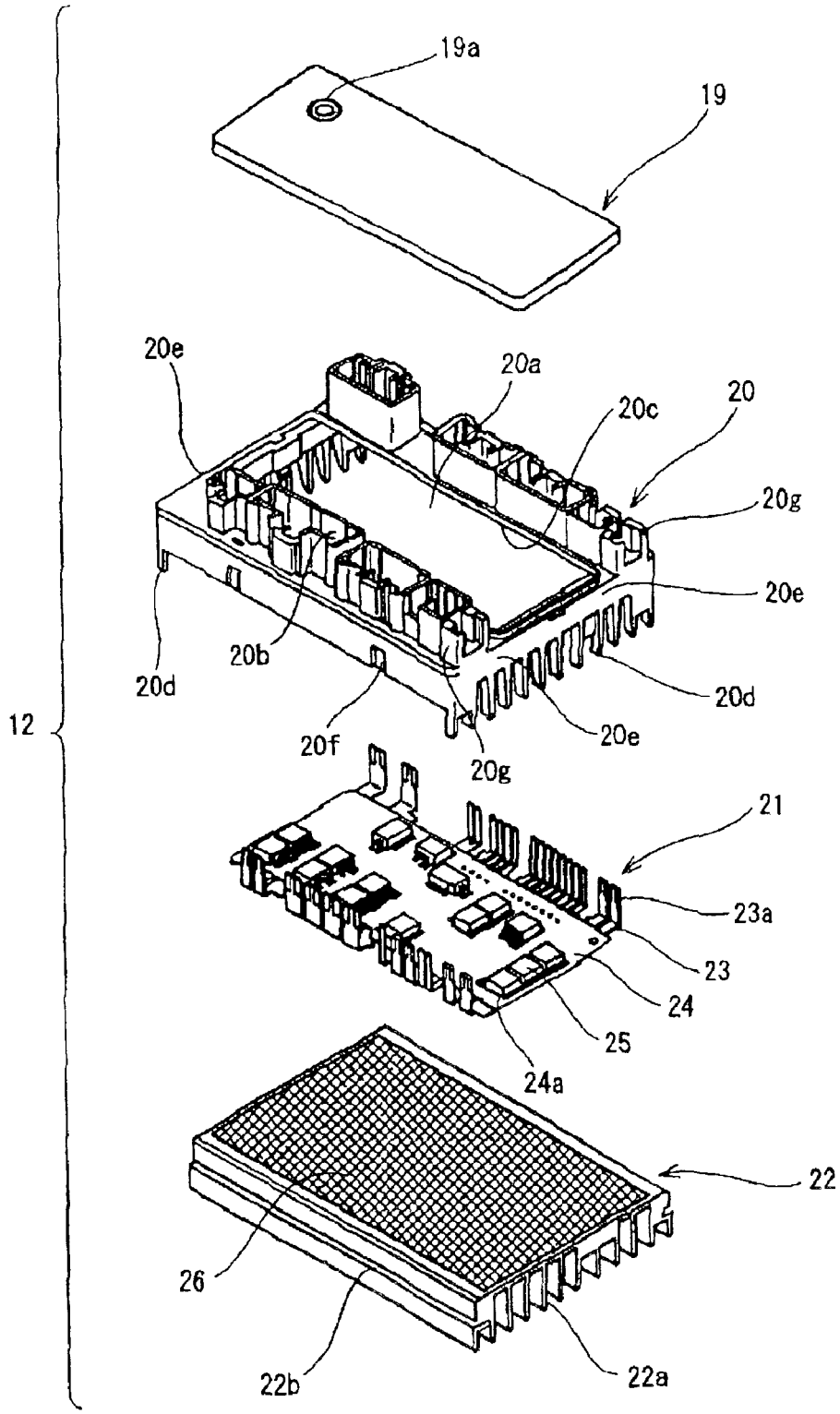
FIG. 3 is an exploded perspective view of the power distribution unit of the first embodiment of the invention.
Figure 4:
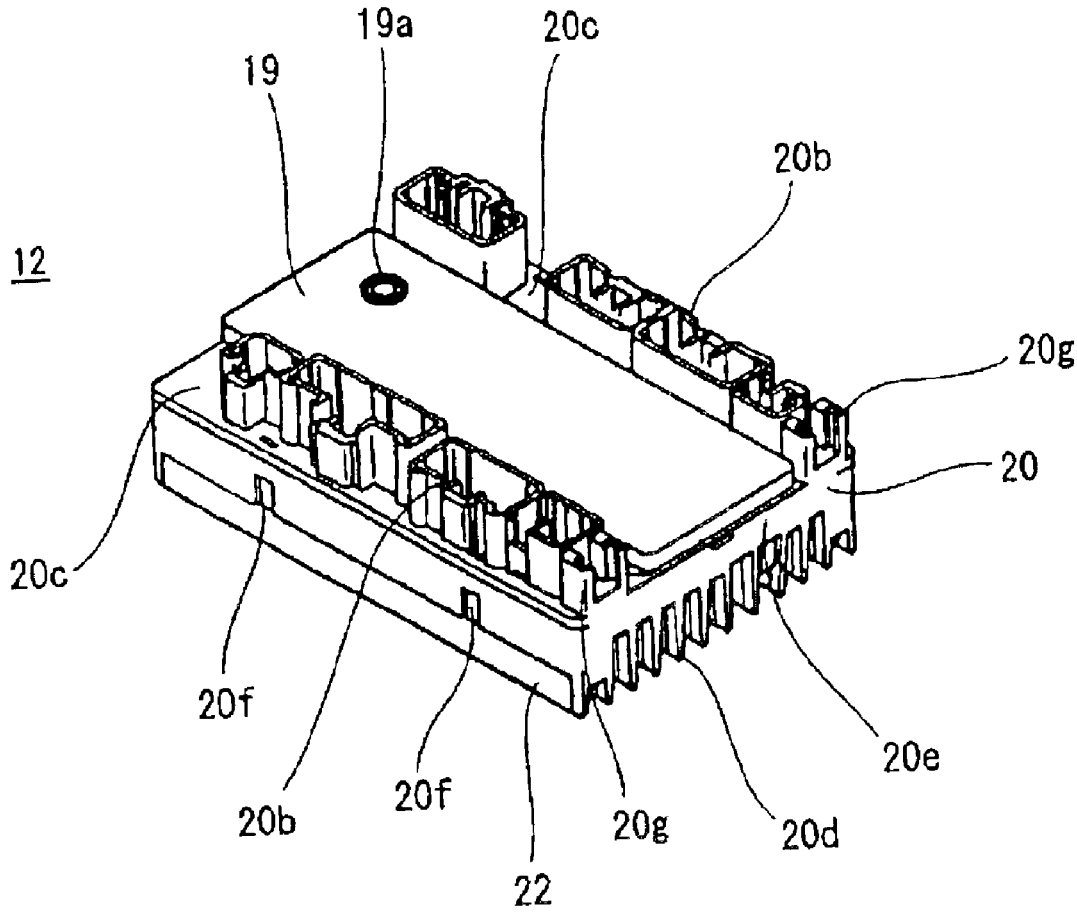
FIG. 4 is a perspective view of the assembled power distribution unit shown in FIG. 3.

As illustrated in FIG. 3, PDU 12 is an assembled structure including a cover 19, a circuit board frame 20, a circuit board 21, and a metal plate 22. Circuit board 21 includes bus bars 23 soldered to the underside of a printed circuit board 24. Electronic components, such as semiconductor switching elements (FETs) 25, extend through the upper surface of printed circuit board 24 through openings 24*a*. Tabs 23*a* are upwardly bent ends of bus bars 23 which extend above opposing edges of circuit board 24.

Circuit board frame 20 is a rectangular frame structure made of any suitable material, such as electrically insulating plastic resin, and surrounds a central opening 20*a* formed there through. When the PDU 12 is vertically mounted onto the connector box, multiple connector receptacles 20*b* extend into case 11. As shown in FIG. 3, circuit board frame 20 includes right and left frame members 20*c* and upper and lower frame members 20*e*. Connector receptacles 20*b* are provided on right and left frame members 20*c*. Notches 20*f* are provided on the sides of frame members 20*c*. Fins 20*d* are provided on upper and lower frame members 20*e* and extend outwardly when the PDU 12 is installed into case 11. Nut holders 20*g* are provided at each end of the upper frame member 20*e*.

The upper and lower edges of metal plate 22 are encompassed by the fins 20*d* of circuit board frame 20. A side rail 22*b* in the form of an indented ledge portion is provided on the side of metal plate 22. The surface of metal plate 22 opposed to circuit board 21 (the upper surface as viewed in FIG. 3) is covered with an electrically insulating layer 26 made of any suitable material, such as a hardened epoxy-based plastic resin.

Cover 19 is installed over central space 20*a* of circuit board frame 20, and covers printed circuit board 21. A fill opening 19*a* is provided on cover 19 for pouring in of a potting agent.

The PDU 12 is assembled, as illustrated in FIG. 3, by mounting circuit board 21 onto an insulated resin layer 26 of metal plate 22, and installing circuit board frame 20 over circuit board 21. Both ends of cooling fins 22*a* on metal plate 22 are held between corresponding fins 20*d* on circuit board frame 20, and notches 20*f* on frame member 20*c* abut against side rail 22*b* of metal plate 22. Cover 19 is then placed over central space 20*a* of circuit board frame 20 to cover the exposed circuit board 21, and the potting agent is poured in through fill orifice 19*a* to form the PDU 12 structure shown in FIG. 4.

Side opening 11*a* extends inward from an external vertical wall of case 11 adjacent to large compartment 11*m*. The PDU 12 is installed into case 11 through the vertical opening 11*a*. An elongated bolt hole 11*c* and a round bolt hole 11*d* are provided in an upper frame plate 11*b* which defines the upper end of opening 11*a*. A pair of protruding lock tabs 11*g* are provided on right and left receiver members of case 11 adjacent to side opening 11*a* for securing side frame 13 thereto. Brackets 11*k* extend from case 11 for mounting of the connector box to a specific location on a vehicle body.

Side frame 13 is a rectangular frame structure whose frame members define a frame opening 13*b*. Clips 13*a* are provided on left and right frame members of side frame 13 for connection to the perimeter of PDU 12.

First and second lids 17 and 18 are configured to respectively cover first and second upper openings 11*e* and 11*f*. Lower case part 16 is configured to cover bottom opening 11*h* and includes cutout sections 16*a*, 16*b*, and 16*c* that allow for passage of electrical wires there through.

Plural rows of fusible link receptacles 14*a* are provided on the upper surface of fusible link block 14. Plural fusible links are installed in the fusible link receptacles 14*a*, and electrical wires w2, which connect to the fusible links, extend from the underside of block 14. Relay block 15 provides additional installation space for switching components that perform switching functions which cannot be performed by the semiconductor switching elements (FETs) 25 in PDU 12. Relay receptacles 15*a* are provided on the upper surface of relay block 15 for the installation of plug-in type relays. Wires w3, which connect to the plug-in type relays, extend from the underside of relay block 15.

The process through which electrical connector box 10 is assembled will now be described.

Figure 2:
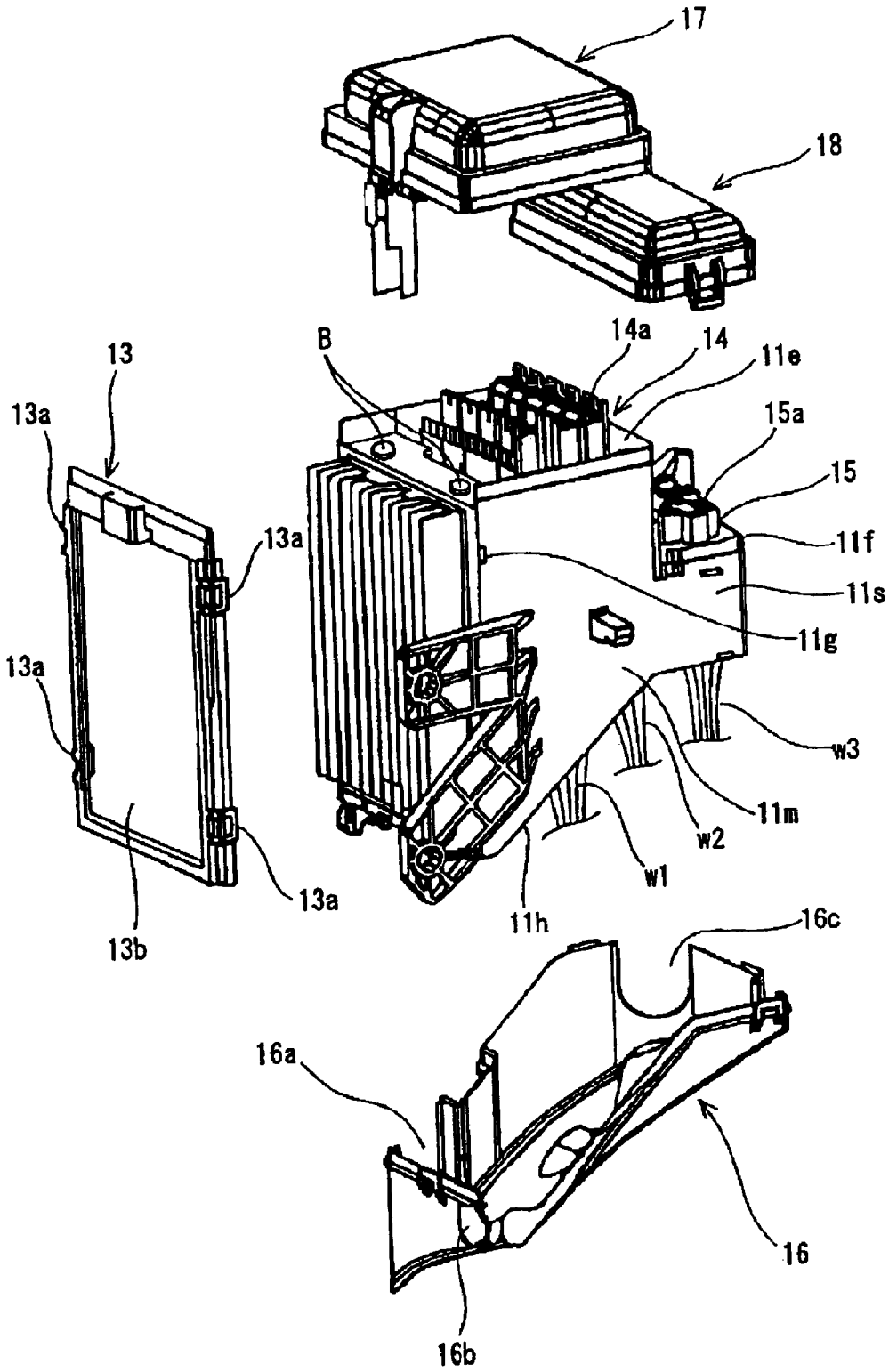
FIG. 2 is a perspective view of the connection box shown in FIG. 1 in which the connector box is partially assembled.

As illustrated in FIGS. 1 and 2, PDU 12 is placed in a vertical position with cooling fins 22*a* extending outward away from the connector box. Connectors C, to which wires w1 are attached, are horizontally inserted into connector receptacles 20*b* on the side of PDU 12 opposite from the cooling fins 22*a*.

The PDU 12 is placed into side opening 11*a* of case 11 in a vertical orientation. Bolts B are inserted through bolt holes 11*c* and 11*d* in case 11, and threaded into nuts (not shown) located in nut holders 20*g* on PDU 12. The upper end of PDU 12 is attached to case 11 through bolts B, but the lower end is not attached in order to prevent the application of stress to circuit board 21 which may damage the circuits held therein.

Side frame 13 is installed over the perimeter of PDU 12 with cooling fins 22*a* outwardly exposed through frame opening 13*b*. Clips 13*a* are connected to lock tabs 11*g* to secure side frame 13 to case 11. The attachment of side frame 13 securely maintains PDU 12 within case 11 while forming a water tight seal at the contact surfaces between the two components.

Fusible link block 14 is installed within large compartment 11*m* through bottom opening 11*h*, and relay block 15 is installed within small space 11*s* through bottom opening 11*h*.

Wires w1, w2, and w3, which are respectively connected to connectors C (inserted in receptacles 20*b* on PDU 12), fusible link block 14, and relay block 15, extend downward from case 11 through respective cutout sections 16*a*, 16*b*, and 16*c* formed in lower case part 16 that covers bottom opening 11*h*. Furthermore, fusible link block 14 is covered by the installation of first lid 17 over upper opening 11*e*, and relay block 15 is covered by the installation of second lid 18 over second upper opening 11*f*.

The use of electronic switching elements (FETs) 25 in circuit board 21, instead of relays, not only allows for the installation of a greater number of branch circuits, but also reduces the weight of the connector box by approximately 15 percent as compared to conventional units. Moreover, locating metal plate 22 and integral cooling fins 22*a* on the side of printed circuit board 24 to which bus bars 23 are attached prevents circuit board 21 from overheating.

Furthermore, orienting PDU 12 in a vertical plane with respect to case 11 reduces the horizontal surface area of case 11 by approximately 30 percent as compared to conventional units. Still further, the vertically oriented installation of PDU 12 to a vertical side of connector box 11 allows for a connector C to plug into a connector receptacle 20*b* in the horizontal direction, thus allowing for a reduction in the length of the wires attached to the connector C.

Figure 5:
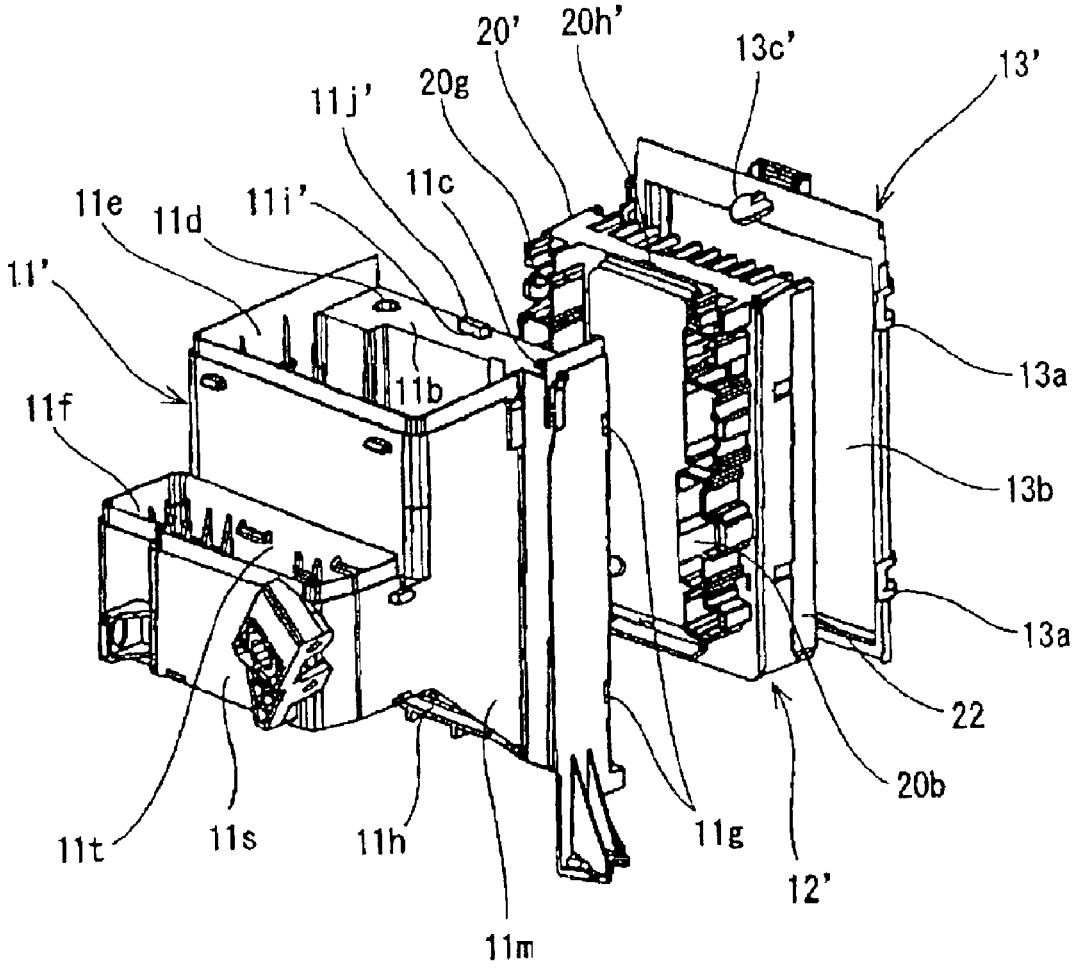
FIG. 5 is an exploded perspective view of the connector box of a second embodiment of the invention.
Figure 6:
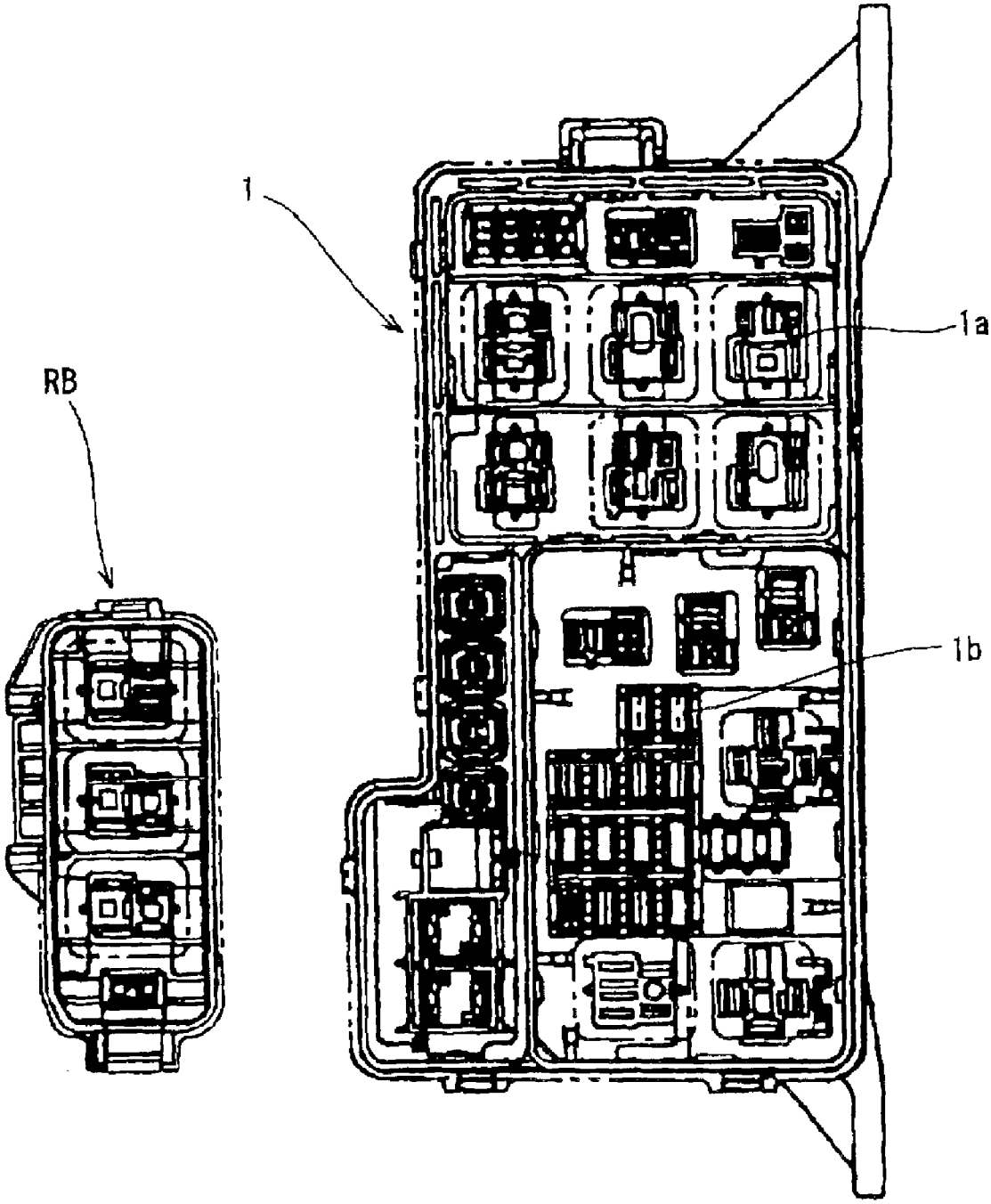
Fig. 6 Prior Art
FIG. 6 is a plan view of a conventional electrical connector box.

A second embodiment of the connector box of the present invention is illustrated by FIG. 5. In this second embodiment, case 11' includes a latch opening 11*i'* provided at the center of an upper frame plate 11*b*, to which PDU 12 is to be attached. A protruding C-shaped latch bracket 11*j'* extends upwardly from the perimeter of latch opening 11*i'*. A latch tab 20*h'* protrudes upwardly from frame 20' of PDU 12' at a location opposing latch opening 11*i'* on case 11'. A stopper lip 13*c'* is provided on side frame 13' at a location opposing latch bracket 11*j'* on case 11'. In FIG. 5, first lid 17, second lid 18, fusible link block 14, relay block 15, and lower case part 16 are not shown. Description of components in the second embodiment which have the same reference numbers as in the first embodiment are not repeated here.

To assemble case 11' of the second embodiment, PDU 12' is placed into side opening 11*a* of case 11', circuit board frame 20' is connected to the inner portion of side opening 11*a*, and latch tab 20*h'* of circuit board frame 20' locks to latch opening 11*i'* of case 11'. This structure provides for the automatic alignment of bolt holes 11*c* and 11*d* with the nuts (not shown in the figure) installed in nut holders 20*g* on circuit board frame 20'.

Side frame 13' is placed against the perimeter of PDU 12', after which stopper lip 13*c'* engages against latch bracket 11*j'* on case 11'. During assembly of side frame 13', stopper lip 13*c'* acts as a guide member that accurately positions side frame 13' against PDU 12', thus providing for quick and easy installation. As a result of this alignment mechanism, clips 13*a* on side frame 13' accurately mate and connect to lock tabs 11*g* on case 11'.

Furthermore, the insertion of stopper lip 13*c'* into latch bracket 11*j'* of case 11' covers lock opening 11*i'* to prevent the entry of water into lock opening 11*i'*. Moreover, since the insertion of stopper lip 13*c'* into latch bracket 11*j'* of case 11' serves as a locking mechanism itself, a more secure locking structure is established between side frame 13' and case 11'.

As described above, the invention provides a structure in which the circuit board in the power distribution unit is equipped with electronic switching elements (FETs) instead of relays, thereby allowing a circuit board that weighs up to 15 percent less than conventional units to incorporate a greater number of branch circuits in higher density. Furthermore, locating cooling fins adjacent to the side of the circuit board to which bus bars are attached prevents the circuit board from overheating. Moreover, locating the power distribution unit on a vertical plane with respect to the connector box reduces the horizontal surface area of the connector box by approximately 30 percent as compared with conventional units.

During insertion of the power distribution unit into the side opening provided in the connector box, the structure that places the latch tab into the latch opening simplifies the assembly of the connector box by accurately aligning the power distribution unit with the case, allowing the bolts to be inserted without the need for manual alignment of the two components. The structure through which the stopper lip on the side frame is inserted into the latch bracket provides an indexing function that aligns the side frame around the perimeter of the power distribution unit, providing for a quick and error-free side frame installation procedure and a strengthened connection between the side frame and connector box. Further, since the latch bracket extends from the perimeter of the latch opening, the latch opening is protected from entry of water by the insertion of the stopper lip into the latch bracket.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Patent Application No. 2002-229181 filed on Aug. 6, 2002, which is herein expressly incorporated by reference in its entirety.

What is claimed:

1. An electrical connector box comprising:

a case having open top and bottom portions, and a side opening provided in a side wall of said case;

a top cover for covering the open top portion;

a bottom cover for covering the open bottom portion;

a power distribution unit including:

a printed circuit board having a first surface with bus bars thereon and a second surface with electronic components thereon, the bus bars and electronic components being electrically connected through openings provided in said printed circuit board;

a circuit board frame surrounding a perimeter portion of said printed circuit board, said circuit board frame including a central opening through which a central portion of said printed circuit board is exposed; and a metal plate having a first surface positioned against said circuit board frame to cover the first surface of said printed circuit board, said metal plate including cooling fins on a second surface thereof and a side frame engaging a perimeter of said power distribution unit and connected to said case for mounting said power distribution unit onto said case with the cooling fins exposed, wherein said power distribution unit is inserted into and covers the side opening of said case in a vertical orientation, so that the electronic components on the second surface of said printed circuit board are oriented toward an interior of said case, and the cooling fins are oriented toward an exterior of said case.

2. The electrical connector box according to claim 1, wherein said circuit board frame includes plural terminal connector receptacles which extend toward the interior of said case, and the bus bars include end tab portions bent around edges of said printed circuit board and extending beyond the second surface of said printed circuit board into the terminal connector receptacles of said circuit board frame, so that terminal connectors on the ends of electrical wires are horizontally inserted into the terminal connector receptacles with the electric wires extending through cutout portions provided in said bottom cover.

3. The electrical connector box according to claim 1, wherein said circuit board frame includes plural parallel fins which extend toward the exterior of said case, the fins of said circuit board frame being aligned with and adjacent to end portions of the cooling fins of said metal plate.

4. The electrical connector box according to claim 1, wherein said power distribution unit includes an upper latch tab configured to engage a latch opening provided in a wall of said case above the side opening, and said power distribution unit is fastened to said case with at least one bolt and at least one nut.

5. The electrical connector box according to claim 1, wherein said case includes opposed wall portions adjacent to the side opening, the opposed wall portions including plural lock tabs configured to engage with plural lock clips provided on said side frame for connecting said side frame to said case.

6. The electrical connector box according to claim 1, wherein said case includes an inner partition wall separating a large inner compartment configured to contain a fusible link block from a small inner compartment configured to contain a relay block, the side opening being provided in a wall of the large inner compartment, and said bottom cover covering the open bottom portions of the large inner compartment and the small inner compartment, said bottom cover including cutout portions through which electric wires connected to the fusible link block and the relay block extend.

7. The electrical connector box according to claim 1, wherein said side frame includes an upper stopper lip configured to be inserted into a latch bracket provided on a wall of said case above the side opening.

8. The electrical connector box according to claim 7, wherein said power distribution unit includes an upper latch tab configured to engage a latch opening provided in the wall of said case above the side opening.

9. The electrical connector box according to claim 8, wherein the latch bracket extends upwardly from the perimeter of the latch opening, whereby insertion of the stopper lip into the latch bracket covers the latch opening.

10. An electrical connector box comprising:

a case containing at least one inner compartment and a side opening provided in a vertical side wall of said case and communicating with the at least one inner compartment;

a power distribution unit inserted into and covering the side opening of said case in a vertical orientation; and a side frame engaging a perimeter of said power distribution unit and connected to said case, said side frame mounted on the perimeter of said power distribution unit to fix said power distribution unit onto said case.

11. The electrical connector box according to claim 10, wherein the at least one inner compartment includes a large inner compartment configured to contain a fusible link block and a small inner compartment configured to contain a relay block, said case further including a bottom having cutout portions through which electric wires connected to the fusible link block and the relay block extend.

12. The electrical connector box according to claim 10, wherein said power distribution unit includes:

a printed circuit board having a first surface with bus bars thereon and a second surface with electronic components thereon;

a circuit board frame surrounding a perimeter portion of said printed circuit board, said circuit board frame including a central opening through which a central portion of said printed circuit board is exposed; and a metal plate having a first surface positioned against said circuit board frame to cover the first surface of said printed circuit board, said metal plate including cooling fins on a second surface thereof.

13. The electrical connector box according to claim 12, wherein said circuit board frame includes plural parallel fins which extend toward the exterior of said case, the fins of said circuit board frame being aligned with and adjacent to end portions of the cooling fins of said metal plate.

14. The electrical connector box according to claim 12, wherein the electronic components on the second surface of said printed circuit board are oriented toward the at least one inner compartment of said case, and the cooling fins on the second surface of said metal plate are oriented toward the exterior of said case.

15. The electrical connector box according to claim 12, wherein said circuit board frame includes plural terminal connector receptacles which extend toward the at least one inner compartment of said case, and the bus bars include end tab portions bent around edges of said printed circuit board and extending beyond the second surface of said printed circuit board into the terminal connector receptacles of said circuit board frame.

16. The electrical connector box according to claim 15, wherein terminal connectors on the ends of electrical wires are horizontally inserted into the terminal connector receptacles of said circuit board frame, and the electric wires extend through cutout portions provided in a bottom of said case.

17. An electrical connector box comprising:

a case containing at least one inner compartment and a side opening provided in a vertical side wall of said case and communicating with the at least one inner compartment;

a power distribution unit inserted into and covering the side opening of said case in a vertical orientation; and a side frame engaging a perimeter of said power distribution unit and connected to said case for mounting said power distribution unit onto said case;

wherein said power distribution unit includes:

a printed circuit board having a first surface with bus bars thereon and a second surface with electronic components thereon;

a circuit board frame surrounding a perimeter portion of said printed circuit board, said circuit board frame including a central opening through which a central portion of said printed circuit board is exposed; and a metal plate having a first surface positioned against said circuit board frame to cover the first surface of said printed circuit board, said metal plate including cooling fins on a second surface thereof.

18. The electrical connector box according to claim 17, wherein the electronic components on the second surface of said printed circuit board are oriented toward the at least one inner compartment of said case, and the cooling fins on the second surface of said metal plate are oriented toward the exterior of said case.

19. The electrical connector box according to claim 17, Wherein to said circuit board frame includes plural terminal connector receptacles which extend toward the at least one inner compartment of said case, and the bus bars include end tab portions bent around edges of said printed circuit board and extending beyond the second surface of said printed circuit board into the terminal connector receptacles of said circuit board frame.

20. The electrical connector box according to claim 17, Wherein terminal connectors on the ends of electrical wires are horizontally inserted into the terminal connector receptacles of said circuit board frame, and the electric wires extend through cutout portions provided in a bottom of said case.

21. The electrical connector box according to claim 17, Wherein said circuit board frame includes plural parallel fins which extend toward the exterior of said case, the fins of said circuit board frame being aligned with and adjacent to end portions of the cooling fins of said metal plate.

* * * * *